US005279270A

United States Patent [19]

Ichikawa et al.

[11] Patent Number: 5,279,270

[45] Date of Patent: Jan. 18, 1994

[54] GOVERNOR FOR INTERNAL COMBUSTION ENGINE

[75] Inventors: Tokihiko Ichikawa, Kariya; Tsugio Ogawa, Kawanishi, both of Japan

[73] Assignee: Kabushiki Kaisha Toyoda Jidoshokki Seisakusho, Kariya, Japan

[21] Appl. No.: 959,702

[22] Filed: Oct. 13, 1992

[30] Foreign Application Priority Data

Oct. 11, 1991 [JP] Japan ..... 3-292070

[51] Int. Cl.[5] ..... F02D 9/08

[52] U.S. Cl. ..... 123/336; 123/350; 123/389

[58] Field of Search ..... 123/389, 341, 336, 350, 123/351, 360, 320, 442

[56] References Cited

U.S. PATENT DOCUMENTS

| | | | |
|---|---|---|---|
| 2,355,881 | 8/1944 | Mallory | 123/389 |
| 2,372,274 | 3/1945 | Hoppe | 123/351 |
| 2,828,725 | 4/1958 | Hartzell et al. | 123/389 |
| 3,756,209 | 9/1973 | Hida et al. | 123/389 |
| 4,078,631 | 3/1978 | Kadota et al. | 123/360 |
| 4,224,907 | 9/1980 | Lefeuvre et al. | 123/360 |

*Primary Examiner*—Andrew M. Dolinar
*Attorney, Agent, or Firm*—Brooks Haidt Haffner & Delahunty

[57] ABSTRACT

The piston actuator for a governor valve in a carburetor is coupled through an electromagnetically operable selector valve to either atmospheric pressure in the air filter or to vacuum in an intake manifold. The selector valve is controlled by engine speed detected by speed detecting means, and by a switch controlled by the accelerator linkage to close a circuit whenever the accelerator pedal is depressed to within a range bordering maximum depression. When the accelerator pedal is depressed to within the above range, and engine speed is below a predetermined value, the selector valve connects to the manifold to interrupt operation of the governor valve. Operation of the governor valve resumes when the speed reaches the preset value or the accelerator pedal leaves said range.

11 Claims, 8 Drawing Sheets

GOVERNOR FOR INTERNAL COMBUSTION ENGINE

BACKGROUND OF THE INVENTION

The present invention relates to a governor or an internal combustion engine especially for an industrial vehicle such as a forklift truck.

There is shown in FIG. 16 a known carburetor assembly in which a governor device 54 for controlling the maximum rotational speed (NMR) of an engine in a no-load condition is interposed between a carburetor 52 and an intake manifold 63. A governor valve 55 of the governor 54 is rotatably supported on a shaft 56 in an air/fuel mixture supply passage 60 so as to control the flow through the air/fuel mixture supply passage 60. The governor valve 55 is normally biased to its fully open position by a spring (not shown).

A piston 57 is connected through an operating rod 58 to the governor valve 55. The piston 57 is reciprocatively disposed in a cylinder chamber 59 partitioning the cylinder chamber 59 into a first chamber **59*a* and a second chamber 59*b*. The first chamber 59*a* is placed in communication through a communication passage 61 with the air/fuel mixture supply passage 60 at a position downstream of the throttle valve 53 of the carburetor 52. The second chamber 59*b* is placed in communication through a hose 62 with an air filter 51**.

In operation, when the engine is driven, the piston 57 is reciprocated in response to a change in pressure in the air/fuel mixture supply passage 60 to thereby control the position of the governor valve 55 and control the quantity of the air/fuel mixture being supplied to the engine, thus controlling the rotational speed of the engine.

FIG. 17 is a graph showing the output characteristic of the engine with the above prior art governor device compared with the output characteristic of an engine without such governor device.

As apparent from FIG. 17, the maximum output of the engine with the air governor device is lower by about 15% to 30% (shown by H in FIG. 17) than that of the engine with no air governor device. This is considered to be due to the fact that the presence of the governor valve 55 in the air/fuel mixture supply passage 60 causes flow resistance. That is, the engine with the governor device in the prior art cannot derive full power.

SUMMARY OF THE INVENTION

It is accordingly an object of the present invention to provide a governor device for an internal combustion engine, especially for an industrial vehicle, improved so as to derive full available engine power (output) by temporarily interrupting the operation of the piston controlling the governor valve.

According to the present invention there is provided a governor for limiting the speed of an internal combustion engine in which a carburetor supplies an air/fuel mixture to the engine under the control of an accelerator input member movable between minimum and maximum positions, said carburetor comprising an air/fuel mixture supply passage and a throttle valve disposed within said supply passage operatively coupled to said input member; a governor valve disposed within said supply passage downstream of said throttle valve, biasing means coupled to said governor valve for urging said governor valve to a valve open position, actuator means operatively coupled to said governor valve for urging said governor valve in a valve closing direction; means for detecting the operating speed of said engine; means for detecting operation of said accelerator input member within a predetermined range adjacent its maximum position; and control means coupled to said actuator means for operating said actuator means selectably in a first and a second mode, in said first mode said actuator means being controlled as a function of the pressure drop across said throttle valve, and in said second mode said actuation means being controlled to disable operation of said governor valve, said control means establishing said second mode of operation whenever said accelerator input member is within said predetermined range and the speed of said engine detected by said speed detecting means is below a predetermined value.

BRIEF DESCRIPTION OF THE DRAWINGS

The invention will be better understood after reading the following detailed description with reference to the appended drawings in which.

The same reference numerals are used throughout the various Figs. of the drawings to designate the same or similar parts.

DETAILED DESCRIPTION OF THE PRESENTLY PREFERRED EMBODIMENTS

Figure 1:
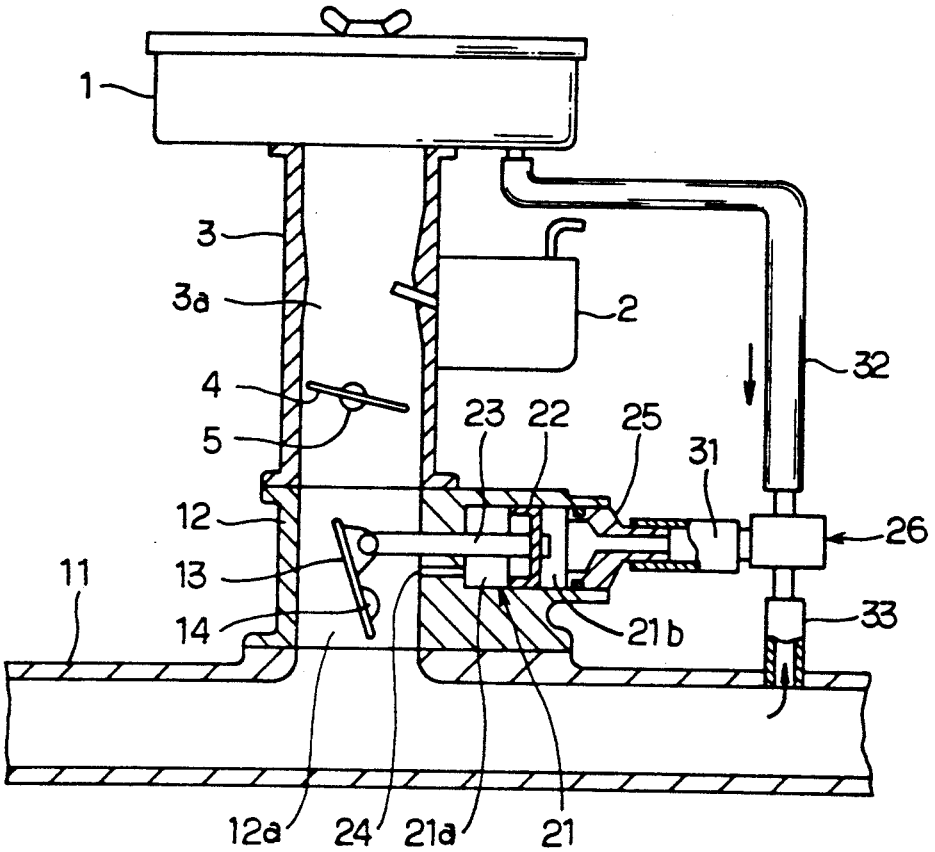
FIG. 1 is a vertical sectional view showing a first embodiment of the present invention.

A preferred embodiment of the present invention will now be described with reference to the drawings. FIG. 1 shows a fuel system provided with a governor device according to the present invention.

As shown in FIG. 1, atmospheric air introduced through an air cleaner or filter 1, and fuel (gasoline) supplied from a float chamber 2 are mixed with each other in a carburetor 3, and the quantity of the air/fuel mixture is controlled by a throttle valve 4.

Figure 3:
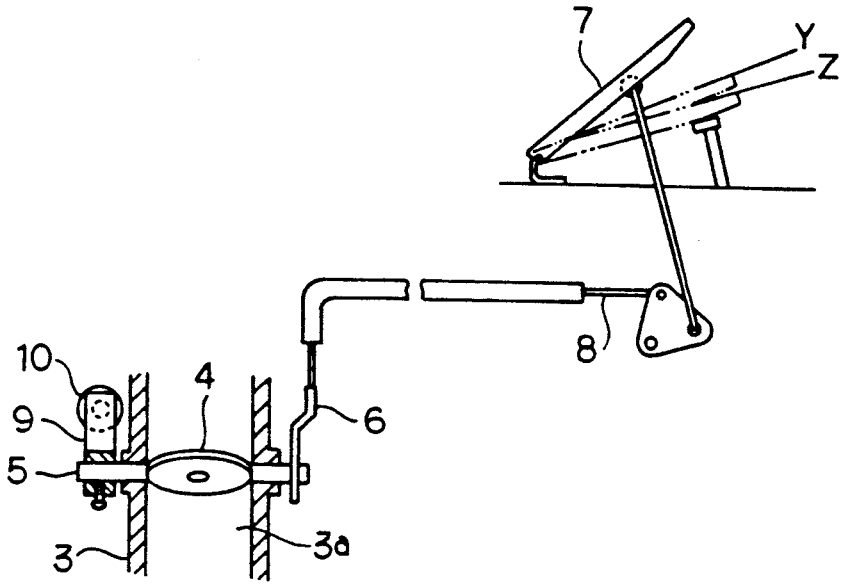
FIG. 3 is a schematic illustration of a throttle valve operating system and pedal depression angle detecting means.

As shown in FIG. 3, the throttle valve 4 is rotatably mounted in air/fuel mixture supply passage 3*a* of the carburetor 3 on a shaft 5 so as to control the opening area of the air/fuel mixture supply passage 3*a*. An accelerator arm 6 is fixed to one end of the shaft 5. The accelerator arm 6 is connected through an accelerator cable 8 to an accelerator pedal 7 adapted to be depressed by an operator.

Figure 4:
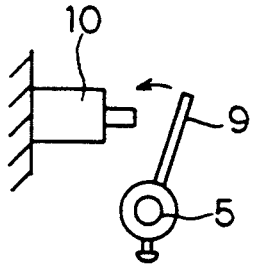
FIG. 4 is a schematic illustration of the pedal depression angle detecting means of FIG. 3.

As shown in FIGS. 3 and 4, connected to the other end of the shaft 5 is a switch operating arm 9 for operating a switch 10 mounted on an outer surface of the carburetor 3. The switch 10 functions as a pedal depression angle detecting means. The switch 10 is closed within an angular range between Y and Z shown in FIG. 3 when the accelerator pedal 3 is depressed in the vicinity of its maximum travel.

Referring back to FIG. 1, a governor device 12 is interposed between the carburetor 3 and an intake manifold 11, and a governor valve 13 is rotatably mounted in an air/fuel mixture supply passage 12*a* of the governor device 12 on a shaft 14 so as to control the opening of the air/fuel mixture supply passage 12*a*. The governor valve 13 is normally biased to its fully open position by a spring 17 (see FIG. 5).

Figure 5:
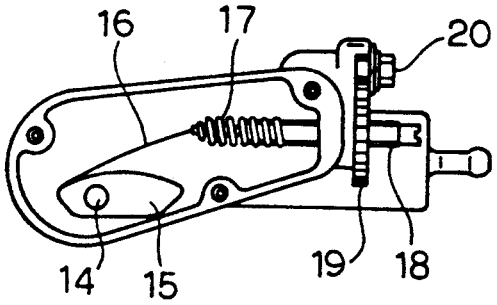
FIG. 5 is a schematic illustration of the governor valve biasing means for use with the apparatus of FIG. 1.

As shown in FIG. 5, a cam 15 is fixed to one end of the shaft 14 outside the governor device 12, and the spring 17 as the biasing means is connected at one end thereof through a leaf spring 16 to the cam 15. The other end of the spring 17 is threadedly engaged with an adjusting screw 18 providing biasing force adjusting means. Further, a screw 19 for fine adjustment is mounted on the adjusting screw 18. The screw 19 is adapted to be locked against rotation by a locking bolt 20.

As shown in FIG. 1, the governor device 12 is provided with a cylinder chamber 21, and a piston 22 is reciprocatively disposed in the cylinder chamber 21. The piston 22 is connected through an operating rod 23 to the governor valve 13.

The cylinder chamber 21 is partitioned by the piston 22 into a first chamber 21*a* on the side of the operating rod 23 and a second chamber 21*b* on the other side opposite to the operating rod 23. The first chamber 21*a* is placed in communication through a communication passage 24 with the air/fuel mixture supply passage 12*a* at a position downstream of the throttle valve 4 and just upstream of the governor valve 13. Accordingly, a vacuum in the air/fuel mixture supply passage 12*a* is normally applied to the first chamber 21*a* during engine rotation chamber (the first chamber 21*a* will be hereinafter referred to as vacuum chamber 21*a*).

Figure 2:
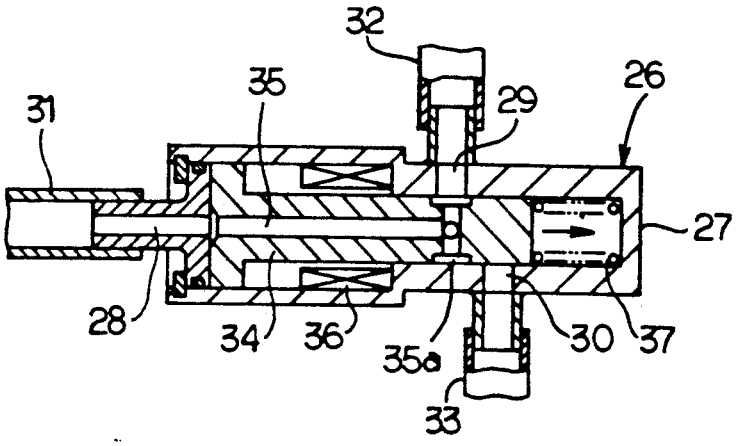
FIG. 2 is a longitudinal sectional view showing the details of the electromagnetic vacuum valve in the apparatus of FIG. 1.

A nipple 25 is mounted in the second chamber 21*b* and an electromagnetic vacuum valve 26 is connected to the nipple 25. FIG. 2 shows the details of the electromagnetic vacuum valve 26.

As shown in FIG. 2, a valve body 27 of the electromagnetic vacuum valve 26 has three ports 28, 29 and 30. The first port 28 is connected through a hose or pipe 31 to the nipple 25. The second port 29 is connected through a hose 32 to the air cleaner 1. The third port 30 is connected through a pipe 33 to the intake manifold 11.

A piston (spool) 34 in the form of a movable iron core formed of a magnetic material is axially movably disposed in the valve body 27. The piston 34 is provided with an axially extending centrally located passage 35. The passage 35 is open at one end thereof to be normally in communication with the port (introduction port) 28 connected to the nipple 25. The other end of the passage 35 is open to an annular groove 35*a* formed on an outer circumference of the piston 34, and is selectively placed in communication with either the second port (atmospheric port) 29 connected to the air cleaner 1 or the third port (vacuum port) 30 connected to the intake manifold 11.

A solenoid 36 is mounted in the valve body 27 so as to surround the piston 34. When the solenoid 36 is unexcited, one axial end of the piston 34 is biased axially (leftwardly as viewed in FIG. 2) by a spring 37 disposed under compression in the valve body 27, and the piston 34 is held in a position where the passage 35 is connected with the atmospheric port 29. In contrast, when the solenoid 36 is excited, the piston 34 is moved axially (rightwardly as viewed in FIG. 2) against the spring 37, and is held in a position where the passage 35 is connected with the vacuum port 30.

That is, either atmospheric pressure or vacuum is selectively applied to the second chamber 21*b* of the cylinder chamber 21 by operating the vacuum valve 26. The second chamber 21*b* will hereinafter be referred to as a variable pressure chamber 21*b*.

Figure 7:
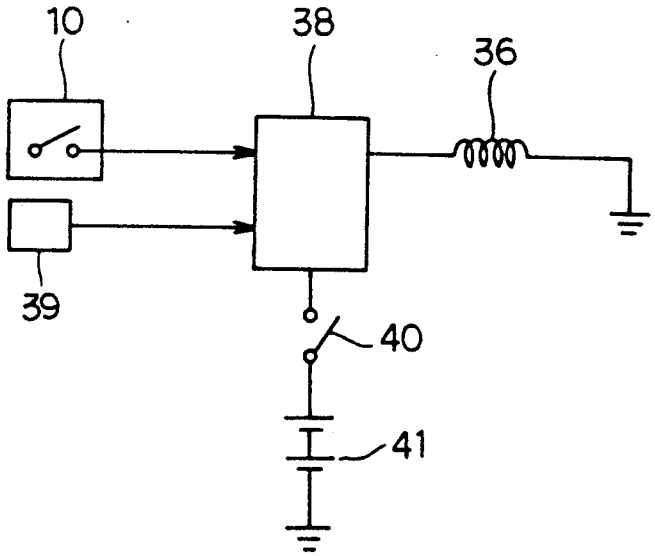
FIG. 7 is a schematic diagram of the control circuit for the valve in FIG. 2.

FIG. 7 is a control diagram for the electromagnetic vacuum valve 26. As shown in FIG. 7, a vacuum valve driving circuit 38 receives the pedal depression angle detection signal (on/off signal) from the switch 10, and a signal from an engine speed detector 39. If switch 10 is closed and the engine speed is lower than a preset speed $N_0$, the vacuum valve driving circuit 38 generates a driving signal to the solenoid 36 of the vacuum valve 26. If the engine speed reaches the preset speed $N_0$, the generation of the driving signal is interrupted.

The vacuum valve driving circuit 38 may be constructed by utilizing a known igniter control unit, an electronic circuit in a transistor type ignition device, for example. In FIG. 7, reference numerals 40 and 41 denote a power supply switch and a battery, respectively.

Figure 6:
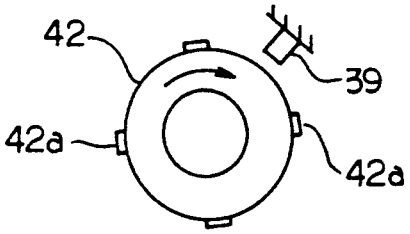
FIG. 6 is a schematic illustration of engine speed detecting means.

Further, as shown in FIG. 6, a plurality of projections 42*a* are provided on a rotating member 42 connected to a crank pulley or a crankshaft, and the number of times the projections 42*a* pass the detector 39 per unit time is detected as the engine speed.

The operation of the governor device in the above described embodiment will now be described. When the engine is stopped, the throttle valve 4 is maintained in a minimum opening position, and the governor valve 13 is maintained in a maximum opening position adjusted by the spring 17. Further, the vacuum valve 26 is maintained in the initial position shown in FIG. 2 where the variable pressure chamber 21*b* is in communication with atmospheric pressure.

Figure 8:
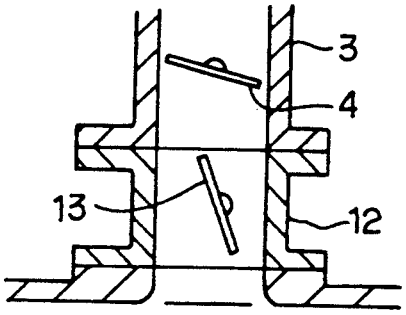
FIG. 8 is a sectional view showing the operation of the governor in FIG. 1 in an idling condition.

When the engine is started from this condition to assume an idling condition as shown in FIG. 8, the throttle valve 4 is kept in the minimum opening position. On the other hand, a vacuum in the air/fuel mixture supply passage 12a is supplied to the vacuum chamber 21a of the cylinder chamber 21, and atmospheric pressure is supplied to the variable pressure chamber 21b. Accordingly, the piston 22 is moved leftwardly as viewed in FIG. 1 to a position where it balances the tension of the spring 17. However, since the vacuum at idling is small, the governor valve 13 is kept in a substantially fully open position.

Figure 9:
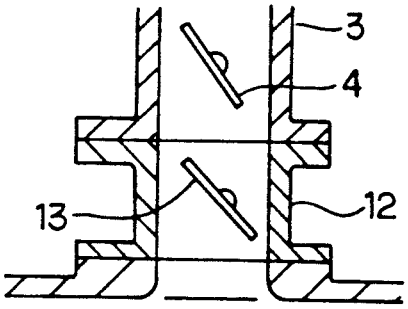
FIG. 9 is a sectional view showing the operation of the governor of FIG. 1 in a normal running condition.

When the accelerator pedal 7 is normally depressed from the idling condition, the opening of the throttle valve 4 is increased as shown in FIG. 9. Accordingly, the vacuum supplied to the vacuum chamber 21a of the cylinder chamber 21 is increased, so that the governor valve 13 is rotated further in a closing direction through the action of the piston 22. As a result, the quantity of the air/fuel mixture is restricted to limit the increase in engine speed.

Figure 13:
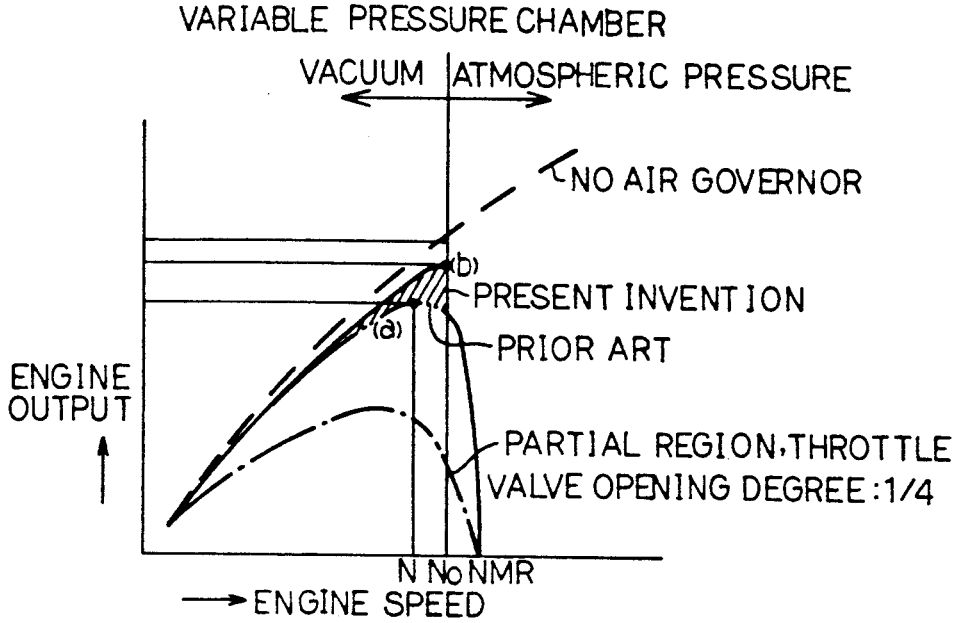
FIG. 13 is a graph showing various engine output characteristics.

Accordingly, in a normal operating region where the accelerator pedal 7 is normally depressed, an output characteristic similar to that in the prior art can be obtained as shown by the partial region in FIG. 13. The partial region shown in FIG. 13 corresponds to the case where the opening of the throttle valve 4 is $\frac{1}{4}$.

When the accelerator pedal 7 is substantially fully depressed to the angular range of Y to Z, so as to obtain a high output, the switch 10 is operated by the switch operating arm 9 to become on (close its contacts). At this time, the engine speed is lower than the preset speed $N_0$. Accordingly, the vacuum valve driving circuit 38 generates a driving signal to the vacuum valve 26.

That is, the solenoid 36 is excited to move the piston 34 of the vacuum valve 26 rightwardly as viewed in FIG. 2 to change the connection of the passage 35 from the atmospheric port 29 to the vacuum port 30. As a result, the vacuum in the intake manifold 11, instead of the atmospheric pressure, is applied to the variable pressure chamber 21b of the cylinder chamber 21. Since the vacuum applied to the variable pressure chamber 21b is the same as the vacuum applied to the vacuum chamber 21a, the piston 22 substantially stops its operation.

Figure 10:
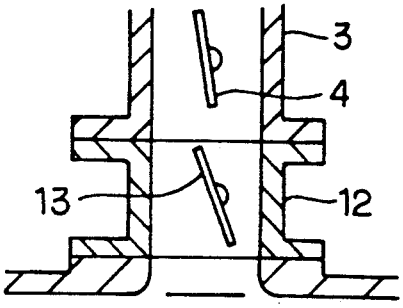
FIG. 10 is a sectional view showing the operation of the governor of FIG. 1 in a high-output running condition.

Accordingly, as shown in FIG. 10, the governor valve 13 is returned to the substantially fully open position by the spring 17, and this condition is continued until the engine speed reaches the preset speed $N_0$. As a result, the supply of the air/fuel mixture is increased to obtain a high output.

FIG. 13 shows various engine output characteristics, wherein a solid line shows the output characteristic of an engine with the governor device according to the above-described embodiment; a dashed line shows the output characteristic of an engine with no air governor device; and a one-dot chain line shows the output characteristic of an engine with the governor device of the prior art. As apparent from FIG. 13, the output characteristic of the present embodiment approximates the output characteristic with no governor (actually, the former has a loss due to flow resistant of the governor valve 13), and can achieve a maximum output (b) higher than that (a) with the governor device of the prior art. In FIG. 13, reference character N denotes an engine speed at the maximum output in the prior art.

Thereafter, when the engine speed reaches the preset speed $N_0$ (e.g., about 2800 rpm), the vacuum valve driving circuit 38 interrupts supplying the driving signal to the vacuum valve 26. Accordingly, the solenoid 36 is unexcited, and the piston 34 is therefore returned to the original position by the spring 37 to change the connection of the passage 35 from the vacuum port 30 to the atmospheric port 29.

Figure 11:
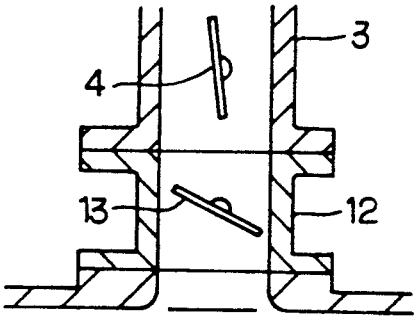
FIG. 11 is a sectional view showing the operation of the governor of FIG. 1 in a maximum engine speed control condition.

Accordingly, atmospheric pressure is applied to the variable pressure chamber 21b of the cylinder chamber 21, and the governor restarts its normal operation. That is, the piston 22 is moved leftwardly as viewed in FIG. 1 to fully close the governor valve 13 as shown in FIG. 11. Accordingly, the engine speed is limited to a preset maximum speed (NMR).

Figure 12:
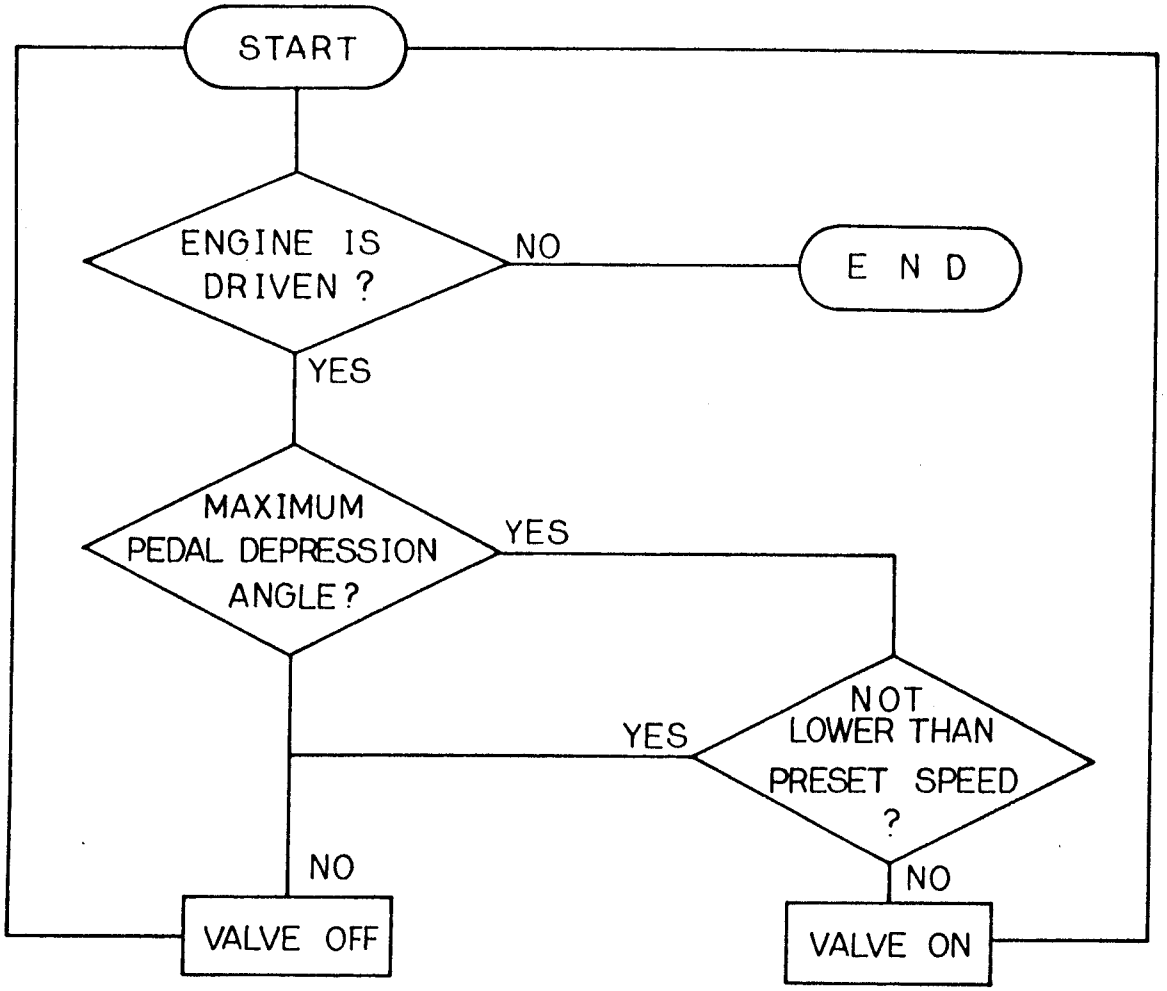
FIG. 12 is a flowchart showing the operation of the valve of FIG. 2.

FIG. 12 is a flowchart of the operation of the governor device mentioned above. The flowchart illustrates that if the depression angle of the accelerator pedal 7 is a maximum and the engine speed is lower than the preset speed $N_0$, a high-output operation is carried out, and otherwise, a normal operation is carried out.

When the accelerator pedal 7 continues to be depressed to the maximum depression angle during the above high-output operation, the selection from atmospheric pressure to vacuum and from vacuum to atmospheric pressure alternately occurs in the vacuum valve 26 at the maximum output point corresponding to the preset speed $N_0$, causing the occurrence of hunting. Such a phenomenon can be eliminated by differentiating the selecting point of the vacuum valve 26 between that for a forward stroke (engine speed increase stroke) and that for a return stroke (engine speed decrease stroke).

Figure 14:
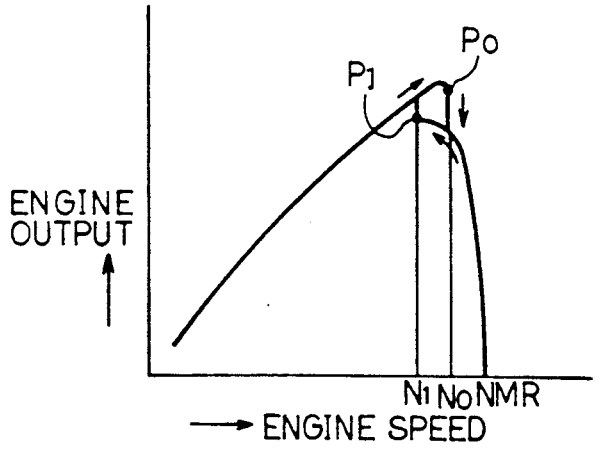
FIG. 14 is a graph showing the operation of hunting eliminating means in a vacuum valve driving circuit.

More specifically, as shown in FIG. 14, such hunting eliminating means can be realized by constructing the vacuum valve driving circuit (igniter) 38 so that the switching between vacuum and atmospheric pressure for controlling the vacuum valve 26 is carried out at a point $P_0$ corresponding to the preset speed $N_0$ during the forward stroke, and the switching from atmospheric pressure to vacuum for controlling the vacuum valve 26 is carried out at a point $P_1$ corresponding to an engine speed $N_1$ lower than the preset speed $N_0$ in the return stroke.

Figure 15:
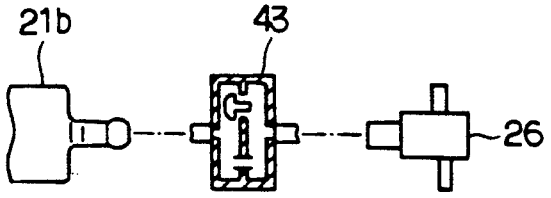
FIG. 15 is a schematic illustration of an embodiment of a hunting eliminating means.
Figure 16:
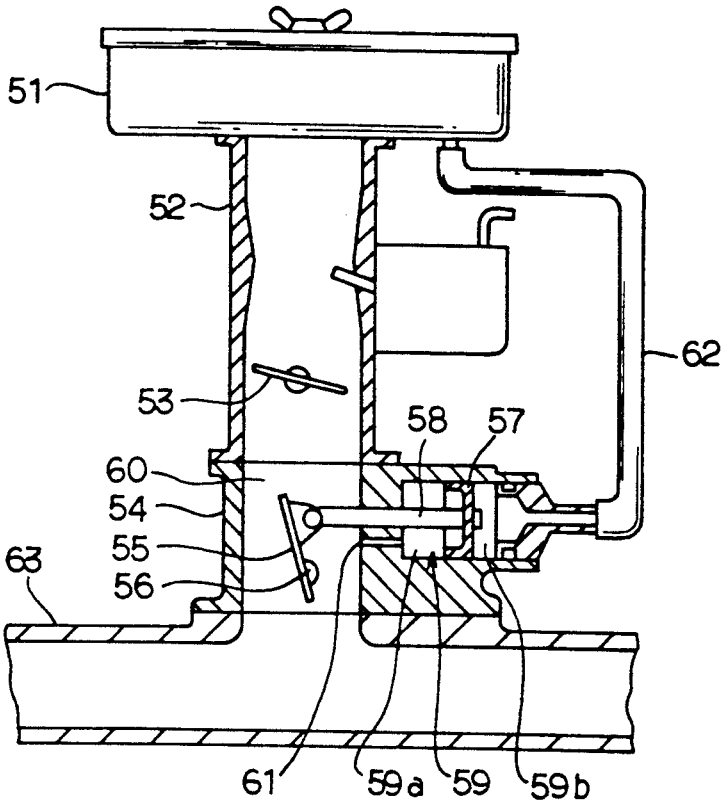
Fig. 16 PRIOR ART
FIG. 16 is a vertical sectional view showing the prior art carburetor and governor assembly.
Figure 17:
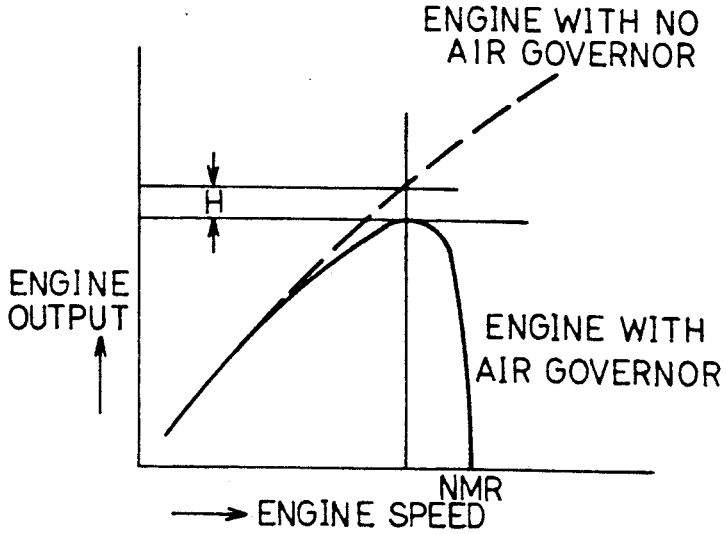
Fig. 17 PRIOR ART
FIG. 17 is a graph showing the output characteristics of an engine with the assembly of FIG. 16.

Another embodiment of the hunting eliminating means is shown in FIG. 15. That is, a valve 43 consisting of a check valve and a restricted orifice providing for asymmetric flow is provided in a passage connecting the vacuum valve 26 to the variable pressure chamber 21b. In the selecting operation of the vacuum valve 26, the selection sensitivity of the vacuum valve 26 is blunted by the damper effect of the valve 43.

As described above, according to the present invention, the power of the engine can be effectively derived to obtain a higher output as compared with the prior art, without reducing the maximum engine speed control function originally possessed by the governor device.

Further, in the governor device of the present invention, while it is normally operated in the same manner as in the prior art, it is operated to derive a high output as required, so that efficient operation can be effected.

Summarizing, the present invention provides a governor device for an internal combustion engine which includes a governor valve located downstream of the throttle valve in an air/fuel mixture supply passage; biasing means for normally biasing the governor valve to its fully open position; a control piston connected through an operating rod to the governor valve, for controlling the extent of opening of the governor valve in response to a pressure in the air/fuel mixture supply passage downstream of the throttle valve; and a cylinder chamber reciprocatively receiving the governor valve actuating piston which divides the chamber into a first chamber and a second chamber partitioned by the piston, the first chamber being coupled through a communication passage to the air/fuel mixture supply passage downstream of the throttle valve; the governor device comprising an electromagnetic vacuum valve coupled to the second chamber of the cylinder chamber and adapted to selectively have either a first position where atmospheric pressure is applied to the second chamber or a second position where an intake manifold vacuum is applied to the second chamber; an accelerator pedal for rotationally operating the throttle valve; pedal depression angle detecting means for detecting the depression angle of the accelerator pedal; engine speed detecting means for detecting engine speed; and a vacuum valve driving circuit for receiving detection signals from the pedal depression angle detecting means and the engine speed detecting means, and for generating a driving signal for the vacuum valve so that the vacuum valve assumes the second position when the depression angle of the accelerator pedal is within a range bordering the maximum and the engine speed is lower than a preset speed, while interrupting the application of the driving signal to the vacuum valve when the engine speed reaches the preset speed.

In the governor device according to the present invention mentioned above, in a normal running condition where the accelerator pedal is not depressed to the range bordering maximum angle, the vacuum valve has the first position where the second chamber is in communication with atmospheric pressure. Accordingly, the piston controlling the governor valve is reciprocated in response to the vacuum in the air/fuel mixture supply passage to control the opening of the governor valve in the same manner as in the prior art. That is, the governor performs its original operation in the normal running condition.

In contrast, when the accelerator pedal is depressed substantially, so as to obtain a high output, a detection signal indicative of the depression angle of the accelerator pedal is input into the vacuum valve driving circuit. If the engine speed at this time is lower than the preset speed, the vacuum valve driving circuit generates a driving signal to the vacuum valve to thereby change the first position of the vacuum valve to the second position where the second chamber is in communication with the vacuum in the intake manifold.

As a result, the governor control piston receives both the vacuum from the air/fuel mixture supply passage and the vacuum from the intake manifold. Since both the vacuums are substantially equal to each other, the piston substantially stops its original operation. Therefore, the governor valve returns to the fully open position set by the biasing means, thereby increasing the supply of the air/fuel mixture to obtain the high output.

Thereafter, when the engine speed reaches the preset speed, the vacuum valve driving circuit stops the production of the driving signal for the vacuum valve, responding to a detection signal from the engine speed detecting means. Accordingly, the vacuum valve is operated to restore the first position where the second chamber is in communication with atmospheric pressure. As a result, the governor control piston resumes its original operation to bring the governor valve into its fully closed position and control the maximum engine speed.

Having described the present invention with reference to the presently preferred embodiments thereof, it is to be understood that various changes can be introduced without departing from the true spirit of the invention as defined in the appended claims.

What is claimed is:

1. A governor for limiting the speed of an internal combustion engine in which a carburetor supplies an air/fuel mixture to the engine under the control of an accelerator input member movable between minimum and maximum positions, said carburetor comprising and air/fuel mixture supply passage and a throttle valve disposed within said supply passage operatively coupled to said input member; a governor valve disposed within said supply passage downstream of said throttle valve, biasing means coupled to said governor valve for urging said governor valve to a valve open position, actuator means operatively coupled to said governor valve for urging said governor valve in a valve closing direction; means for detecting the operating speed of said engine; means for detecting operation of said accelerator input member within a predetermined range adjacent its maximum position; and control means coupled to said actuator means for operating said actuator means selectably in a first and a second mode, in said first mode said actuator means being controlled as a function of the pressure drop across said throttle valve, and in said second mode said actuator means being controlled to substantially fully open said governor valve until the speed of said engine detected by said detecting means reaches a predetermined value, said control means establishing said second mode of operation whenever said accelerator input member is within said predetermined range and the speed of said engine detected by said speed detecting means is below said predetermined value.

2. A governor according to claim 1, wherein said actuator means comprises a cylinder; a piston within said cylinder dividing the interior of said cylinder into a first and second chamber; an operating rod coupling said piston to said governor valve to control the opening thereof; means establishing communication between said first chamber and said carburetor supply passage at a point upstream of said governor valve and downstream of said throttle valve; and means establishing communication between said second chamber and said control means.

3. A governor according to claim 1, wherein said control means includes means for establishing a single predetermined speed for said predetermined speed value.

4. A governor according to claim 1, wherein said control means includes means for establishing two predetermined speeds for said predetermined speed value, one operative during acceleration and the other operative during deceleration.

5. A governor according to claim 1, wherein said means for detecting operation of said accelerator input member comprises a shaft rotatably supporting said throttle valve; an accelerator arm fixed to said shaft and connected to said accelerator input member through an accelerator coupling means; an arm fixed to said shaft; and a switch having two operative conditions located for control by said arm for altering its operative condition when said accelerator input member is within said predetermined range.

6. A governor for limiting the speed of an internal combustion engine in which a carburetor supplies an air/fuel mixture to the engine under the control of an accelerator input member movable between minimum and maximum positions, said carburetor comprising an air/fuel mixture supply passage and a throttle valve disposed within said supply passage operatively coupled to said input member; a governor valve disposed within said supply passage downstream of said throttle valve, biasing means coupled to said governor valve for urging said governor valve to a valve open position, actuator means operatively coupled to said governor valve for urging said governor valve in a valve closing direction; means for detecting the operating speed of said engine; means for detecting operation of said accelerator input member within a predetermined range adjacent its maximum position; and control means coupled to said actuator means for operating said actuator means selectably in a first and a second mode, in said first mode said actuator means being controlled as a function of the pressure drop across said throttle valve, and in said second mode said actuator means being controlled to disable operation of said governor valve, said control means establishing said second mode of operation whenever said accelerator input member is within said predetermined range and the speed of said engine detected by said speed detecting means is below a predetermined value; said actuator means comprising a cylinder, a piston within said cylinder dividing the interior of said cylinder into a first and second chamber, an operating rod coupling said piston to said governor valve to control the opening thereof, means establishing communication between said first chamber and said carburetor supply passage at a point upstream of said governor valve and downstream of said throttle valve, and means establishing communication between said second chamber and said control means.

7. A governor according to claim 6, wherein said control means comprises a valve with three ports and having two operative positions, one position interconnecting a first of said ports with a second of said ports, the other position interconnecting said first port with a third of said ports, said first port being coupled to said second chamber of said actuator cylinder, said second port being coupled to a source of air at atmospheric pressure, and said third port being coupled to a point in an intake manifold of said engine downstream of said governor valve.

8. A governor according to claim 7, wherein said control valve comprises a housing, a piston of magnetic material within said housing, a spring coupled to said piston for biasing said piston to a first position, a solenoid operatively coupled to said piston for urging said piston to a second position when said solenoid is energized, and means for supplying energizing power to said solenoid when said accelerator input member is within said predetermined range and the speed of said engine is below said predetermined value.

9. A governor according to claim 6, wherein an asymmetrically operative flow valve is disposed between said second chamber and said control means in said means for establishing communication therebetween.

10. A governor for limiting the speed of an internal combustion engine in which a carburetor supplies an air/fuel mixture to the engine under the control of an accelerator input member movable between minimum and maximum positions, said carburetor comprising an air/fuel mixture supply passage and a throttle valve disposed within said supply passage operatively coupled to said input member; a governor valve disposed within said supply passage downstream of said throttle valve, biasing means coupled to said governor valve for urging said governor valve to a valve open position, actuator means operatively coupled to said governor valve for urging said governor valve in a valve closing direction; means for detecting the operating speed of said engine; means for detecting operation of said accelerator input member within a predetermined range adjacent its maximum position; and control means coupled to said actuator means for operating said actuator means selectably in a first and a second mode, in said first mode said actuator means being controlled as a function of the pressure drop across said throttle valve, and in said second mode said actuator means being controlled to disable operation of said governor valve, said control means establishing said second mode of operation whenever said accelerator input member is within said predetermined range and the speed of said engine detected by said speed detecting means is below a predetermined value, said control means including means for establishing two predetermined speeds for said predetermined speed value, one operative during acceleration and the other operative during deceleration.

11. A governor for limiting the speed of an internal combustion engine in which a carburetor supplies an air/fuel mixture to the engine under the control of an accelerator input member movable between minimum and maximum positions, said carburetor comprising an air/fuel mixture supply passage and a throttle valve disposed within said supply passage operatively coupled to said input member; a governor valve disposed within said supply passage downstream of said throttle valve, biasing means coupled to said governor valve for urging said governor valve to a valve open position, actuator means operatively coupled to said governor valve for urging said governor valve in a valve closing direction; means for detecting the operating speed of said engine; means for detecting operation of said accelerator input member within a predetermined range adjacent its maximum position which means comprises a shaft rotatably supporting said throttle valve, an accelerator arm fixed to said shaft and connected to said accelerator input member through an accelerator coupling means, an arm fixed to said shaft, and a switch having two operative conditions located for control by said arm for altering its operative condition when said accelerator input member is within said predetermined range; and control means coupled to said actuator means for operating said actuator means selectably in a first and a second mode, in said first mode said actuator means being controlled as a function of the pressure drop across said throttle valve, and in said second mode said actuator means being controlled to disable operation of said governor valve, said control means establishing said second mode of operation whenever said accelerator input member is within said predetermined range and the speed of said engine detected by said speed detecting means is below a predetermined value.

* * * * *